United States Patent [19]

Landreau

[11] Patent Number: 4,785,747

[45] Date of Patent: Nov. 22, 1988

[54] GASIFYING BURNER FOR A SOLID FUEL HEATING APPARATUS

[75] Inventor: Andre Landreau, Fontenay Le Comte, France

[73] Assignee: Chaubois Technologie Inc., Canada

[21] Appl. No.: 41,603

[22] Filed: Apr. 22, 1987

[30] Foreign Application Priority Data

Apr. 25, 1986 [CA] Canada ..... 507586

[51] Int. Cl.[4] ..... F23B 7/00

[52] U.S. Cl. ..... 110/234; 110/297; 110/302; 110/310; 110/318; 122/15; 126/77

[58] Field of Search ..... 110/233, 234, 246, 260, 110/297, 298, 301, 302, 309, 310, 313, 317, 318, 319; 122/15, 136 R; 126/67, 72, 71, 77, 101, 109, 361

[56] References Cited

U.S. PATENT DOCUMENTS

| | | | |
|---|---|---|---|
| 2,127,506 | 8/1938 | Franzheim | 110/297 |
| 2,212,311 | 8/1940 | Alhisi | 110/302 |
| 3,177,865 | 4/1965 | Jones et al. | 126/109 |
| 3,808,988 | 5/1974 | Sugano et al. | 110/246 X |
| 4,226,195 | 10/1980 | Lihdroos | 110/309 X |
| 4,309,965 | 1/1982 | Hill | 122/15 |
| 4,343,266 | 6/1982 | Tjasvold | 126/77 X |
| 4,360,000 | 11/1982 | Dawn | 126/77 |
| 4,479,481 | 10/1984 | Ingersoll et al. | 126/76 |
| 4,516,534 | 5/1985 | Jahier | 110/298 X |

*Primary Examiner*—Steven E. Warner

*Attorney, Agent, or Firm*—Joseph G. Seeber

[57] ABSTRACT

The present invention relates to a gasification burner for heating apparatus (boiler, hot air generator or the like) which uses solid fuel. The gasification burner is placed generally at the center of the hearth of the heating apparatus to achieve gasification of the solid fuel before its transformation into charcoal or coals.

22 Claims, 3 Drawing Sheets

GASIFYING BURNER FOR A SOLID FUEL HEATING APPARATUS

TECHNICAL FIELD

The present invention relates to a gasification burner for heating apparatus (boiler, hot air generator or the like) using solid fuel.

DESCRIPTION OF THE PRIOR ART wood fuel or other solid fuel heating apparatuses are known and have been used for many years. The first apparatuses were very rudimentary and comprised basically a hearth and a chimney.

With the rising cost of fuel and the need for reducing pollution, these apparatuses have become inadequate.

A series of very complex time and temperature dependent chemical reactions occur during the combustion of wood or other solid fuels. The first step is the destructive distillation of the wood by heating it to or above its kindling temperature to distil off combustion gases. In the second step, air is supplied to the distilled combustible gases for combustion, thereby producing the heat required for continuing the destructive distillation step. A part of the non-used heat which is not required for the distillation process is thus available for heating purposes.

Basically, the pollution resulting from the combustion of wood or other solid fuels occurs because the distilled combustible gases are not entirely burned and are exhausted into the atmosphere. The major problem comes from the fact that the combustible gases resulting from the distillation process have a kindling temperature which fluctuates from 385° C. (methanol) and 609° C. (carbon monoxide).

Many apparatuses have been developed to improve the efficiency of the combustion process and to reduce the pollutant content of the gases and smoke exhausted into the atmosphere. For example, see U.S. Pat. Nos. 4,309,965 (Hill) and 4,479,481 (Ingersoll et al), and 860,563 (Landreau et al).

However, none of the known apparatuses can allow for total control of the pollution. Indeed, when such apparatuses and processes are started or stopped, a certain quantity of pollutants is exhausted in the atmosphere.

DISCLOSURE OF THE INVENTION

The present invention has essentially as its object to provide a gasification burner which can be used with a heating apparatus using solid fuel and which can reduce the pollution which occurs when using these apparatuses, including during start up and shut-down operations.

It is a further object of the present invention to provide a gasification burner for heating apparatus for solid fuel which can produce most of the heat required for the distillation of the said solid fuel.

A gasification burner is accordance with this invention comprises an exterior enclosure located generally at the center of the hearth of the heating apparatus. A series of openings are made in the said enclosure. A burner duct runs longitudinally in the inside of the enclosure and comprises at one end an entrance and at the other end an exit. The exit end communicates with an expansion chamber whereas the other end communicates with the said openings and is placed near a secondary air inlet.

BRIEF DESCRIPTION OF THE DRAWINGS

Other characteristics and advantages of the invention will become apparent from the following description and drawings which are provided as examples. In the drawings.

DETAILED DESCRIPTION OF A PREFERRED EMBODIMENT

Figure 1:
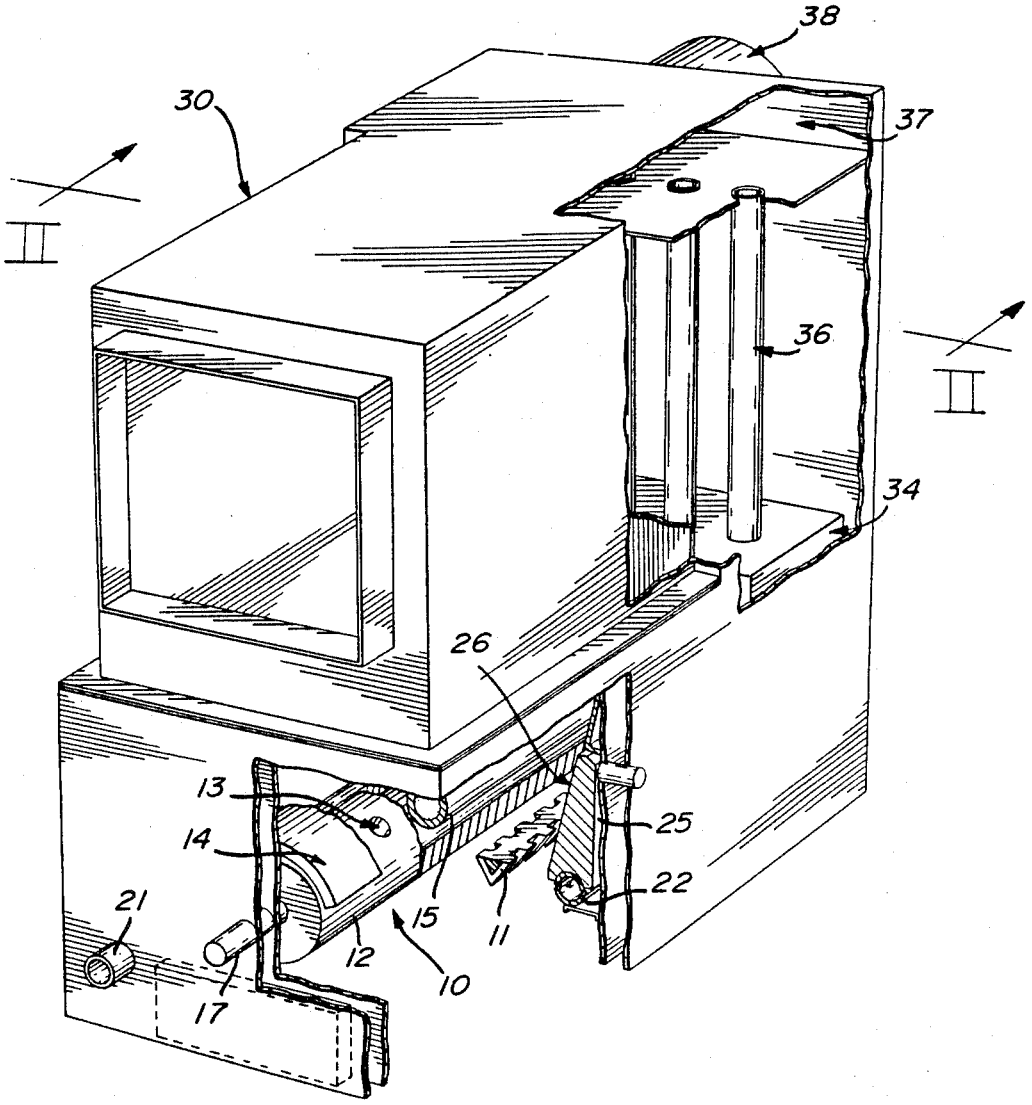
FIG. 1 is a schematic perspective view of a boiler in accordance with the present invention, situating the principal components.
Figure 2:
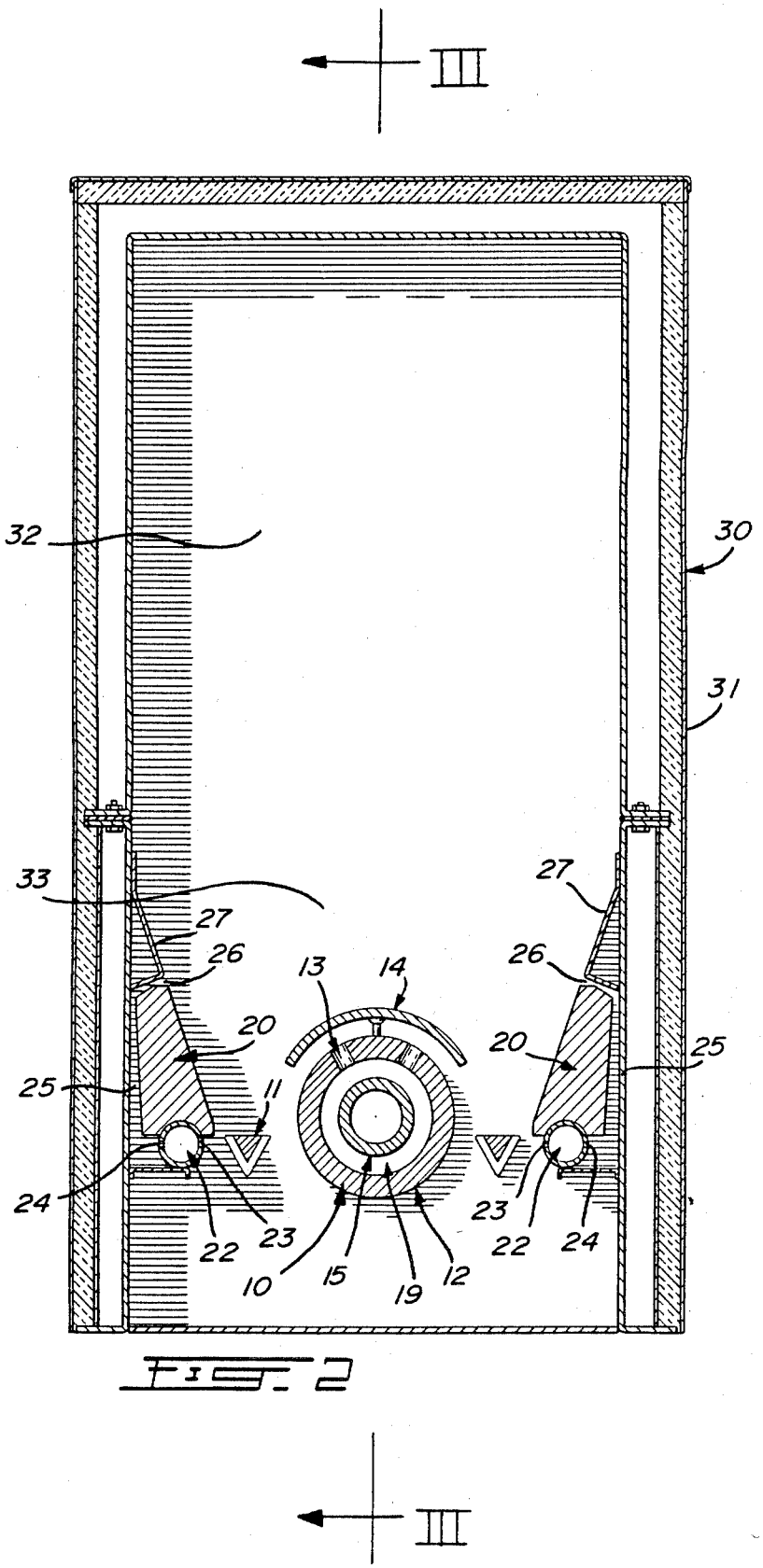
FIG. 2 is an elevated view according to a section passing through line II—II of FIG. 1.
Figure 3:
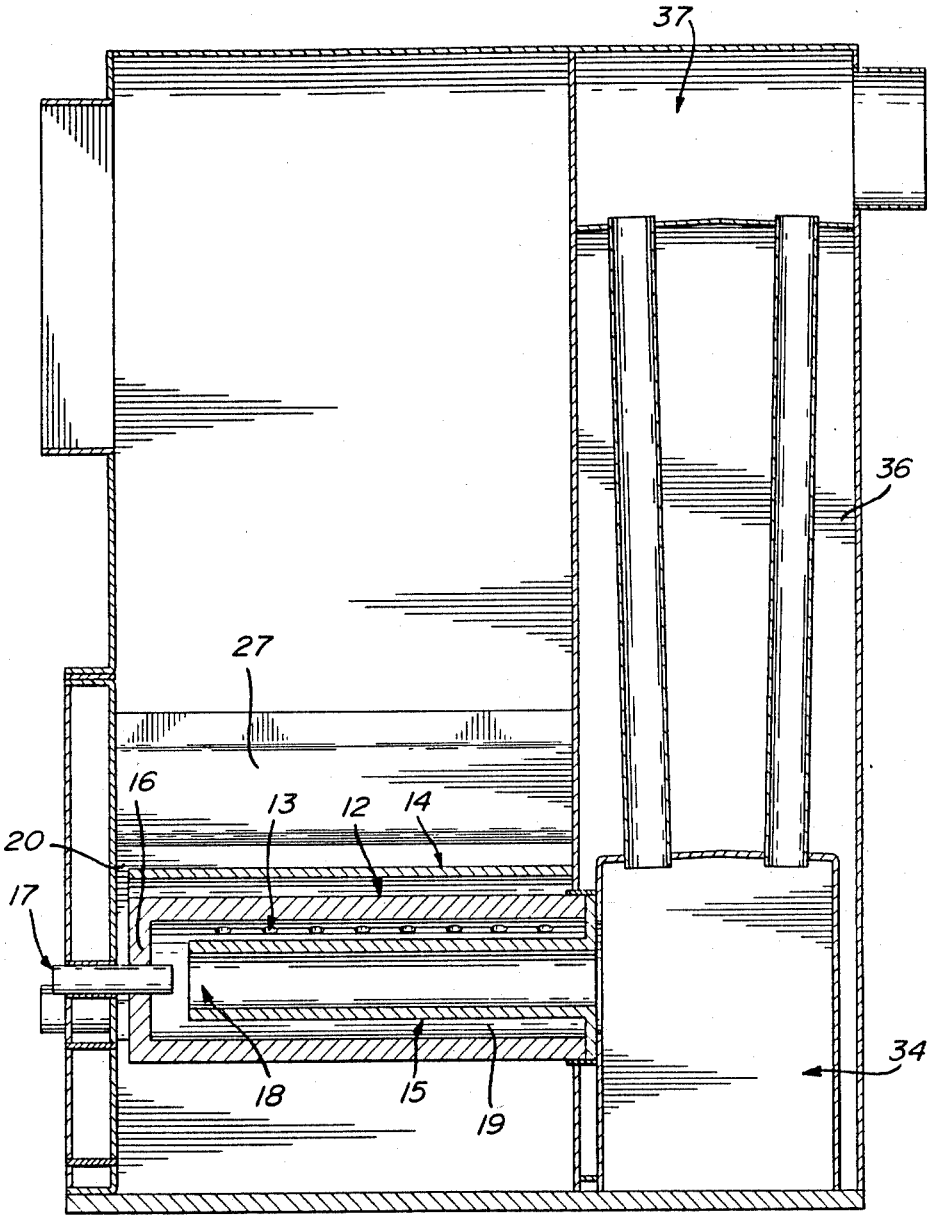
FIG. 3 is an elevated view according to a section passing through line III—III of FIG. 2.

According to the embodiment shown in the figures, the gasification burner 10 is placed according to its axis in the boiler 30 which comprises an insulated jacket 31, a solid fuel reservoir 32 below which is positioned the hearth 33. The gasification burner 10 opens into an expansion chamber 34, above which is situated the heat exchanger 36, itself communicating with a smoke box 37 which communicates with an extractor 38 (known to those skilled in the art).

The lower part of the gasification burner 10 is positioned at the fire grate 11 level.

The gasification burner comprises an outer enclosure 12 comprising a series of intake passages 13 on the upper part of the enclosure 12. A protective cover 14 is placed on the top of the intake passages 13. A burner duct 15 is axially placed inside of the gasification burner 10. The back end of the burner duct 15 communicates with the expansion chamber 34 whereas the front end is opened and ends at a certain distance from the front wall 16 of the enclosure 12. A tube 17 crosses the jacket 31 and the front wall 16 of the enclosure 12 and ends inside the gasification burner at a certain distance from the wall 16.

Shoulders 20 made of refractory materials are placed on each side of the hearth 33. Openings 21 are perforated in the front of the boiler and communicate with tubes 22 below the shoulders 20. A series of lateral openings 23 and 24 are distributed along tubes 22. The openings 23 communicate with the base of the hearth whereas the openings 24 communicate with the openings 26 through the passage 25 situated behind the shoulders 20. The openings 26 are defined by the upper portion of shoulders 20 and by a piece 27 which is fixed above the shoulders 20.

The location of the gasification burner and more particularly its large radiation surface which is situated higher than the fire grate allows the enclosure 12 to reach a very high temperature (1,050° C.) by way of radiation of the burner duct 15 which itself reaches a temperature of 1,200° C. and by the high temperature of the gases which are burning in the said burner duct.

While the burner is running, a gasification occurs before the transformation of the wood into charcoal or coals thus allowing the solid fuel to be gasified according to the calorific needs of the installation.

Primary air is admitted through openings 21 on the front wall of the burner. This air is overheated as it contacts the inside wall of the tubes 22 which are themselves overheated by conductivity of the shoulders 20.

The distribution of the primary air is as follows: 25% through the openings 23 to achieve a complete combustion of the coals above the fire grate 11 and 75% toward the exterior through the opening 24. This air is channeled by the passage 25 and is overheated at an extreme high temperature by the exterior of the shoulders 20 before being injected in the hearth through the openings 26. This air activates the combustion and clears all the gasification produced by the protective cover 14 and the exterior enclosure 12.

The primary air flow is controlled such that the gases produced by the burner radiation are not all ignited. These gases, mixed with the combustion of the coals are aspirated through orifices 13 inside the annular space 19 between the exterior enclosure 12 and the burner duct 15.

Inside the annular space 19, the said gases contact burner duct 15. The temperature of the duct being appromatively 1,200° C., it brings the gases to approximately 1,050° C., which is higher than their flash point. As a result of the combined action of the radiation emanating from duct 15 and the conductibility of the gaseous components, the exterior enclosure 12 can reach a temperature of about 1,050° C.

Afterwards, the gases are channeled in the annular space 19 up to the ignition point 18. At this point 18, the gas constituents are mixed with the secondary air coming in from the tube 17. This mixture igniter at the ignition point 18 and the temperature reaches 1,200° C. The ignited gases continue to burn inside the burner duct 15 and then, expand in the expansion chamber 34 to achieve a complete combustion before contacting the cold walls of the exchanger 36.

The special position of the expansion chamber 34 allows the easy removal off the ash particles which find their way into burner duct 15.

The very high temperature gases (which are practically neutral) are channeled to the exchanger 36 (known) to transfer their energy to an appropriate heat exchanging fluid. A smoke box 37 collects the gases at the end of the exchanger 36. A smoke extractor 38 (known) causes the circulation of the gases in the whole system and transfers the cold gases to a chimney (not shown).

To put the burner in stand-by, it is simply required to close the gas circuit. It takes only a few coals or incandescent charcoals in the hearth to start the gazeification as soon as the gas circuit is reopened.

It should be understood that the invention is not limited to the embodiments chosen or represented, but on the contrary can be the object of modifications without departing from the scope of the invention. For example, the burner system which has been described is designed to be used with a negative pressure combustion apparatus, but it is obvious that the same system can be used with a positive pressure combustion apparatus.

I claim:

1. A gasification burner for a heating apparatus using a solid fuel and comprising a hearth having a base, a lower part of said hearth being defined by a fire grate, the gasification burner comprising:

(a) an outer enclosure comprising a series of openings which communicate with the base of the hearth;

(b) a burner duct distinct from said outer enclosure and which runs longitudinally inside said outer enclosure, said burner duct comprising an inlet located at one end thereof and an outlet located at another end thereof, a space defined between said burner duct and said outer enclosure communicating with said inlet of said burner duct; and (c) a secondary air inlet located near said inlet of said burner duct.

2. A gasifying burner in accordance with claim 1, wherein said openings in said outer enclosure are disposed longitudinally on an upper portion of the outer enclosure.

3. A gasifying burner in accordance with claim 2, comprising a cover placed over said openings of said outer enclosure.

4. A gasifying burner in accordance with claim 1, 2 or 3, wherein said outer enclosure and said burner duct are cylindrically shaped.

5. A heating apparatus using a solid fuel comprising:

(a) a jacket;

(b) a solid fuel reservoir having a loading door;

(c) a hearth disposed below said reservoir and comprising a fire grate placed over an ash pan, said fire grate defining a fire grate level;

(d) a gasifying burner disposed in said hearth;

(e) an expansion chamber communicating with said hearth through said gasifying burner; and (f) a heat exchanger disposed after said expansion chamber, said heat exchanger communicating with a chimney;

said gasifying burner comprising an outer enclosure positioned generally at the center of the fire grate level and a burner duct distinct from said outer enclosure and running longitudinally inside said outer enclosure said burner duct comprising an inlet located at one end thereof and an outlet located at another end thereof, a space defined between said burner duct and said outer enclosure communicating with said inlet of said burner duct.

6. A heating apparatus in accordance with claim 5, wherein said hearth has a base, said apparatus comprising a primary air diffuser located on each side of said base of said hearth.

7. A heating apparatus in accordance in claim 5, wherein said hearth has a base, said apparatus comprising shoulders made of refractory material placed on each side of said base of said hearth and primary air diffusers adjacent to said shoulders.

8. A heating apparatus in accordance with claim 5, wherein said hearth has a base, said gasifying burner comprising:

(a) an interior enclosure having a series of openings disposed therein, said openings communicating with said base of said hearth; and (b) a secondary air inlet disposed near said inlet of said burner duct.

9. A heating apparatus in accordance with claim 8, wherein said outer enclosure has opening disposed longitudinally on an upper portion of said outer enclosure.

10. A heating apparatus in accordance with claim 9, wherein said gasifying burner comprises a cover placed over said openings of said outer enclosure.

11. A heating apparatus in accordance with claim 8 or 10, comprising shoulders made of refractory material placed on each side of said base of said hearth and primary air diffusers adjacent to said shoulders.

12. A heating apparatus in accordance with claim 8, 9 or 10, wherein said outer enclosure and said burner duct are cylindrically shaped.

13. A heating apparatus in accordance with claim 8 or 10, comprising a primary air diffuser located on each side of said base of said hearth.

14. A gasification burner for a heating apparatus using a solid fuel comprising a hearth, a lower part of said hearth being defined by a fire grate, the gasification burner comprising:

(a) an outer enclosure comprising a series of openings disposed longitudinally on an upper portion of said outer enclosure;

(b) a burner duct which runs longitudinally inside said enclosure, said burner duct comprising an inlet and an outlet, a space defined between said burner duct and said outer enclosure communicating with said inlet of said burner duct;

(c) a secondary air inlet located near said inlet of said burner duct; and (d) a cover placed over said openings of said outer enclosure.

15. A gasifying burner in accordance with claim 14, wherein said outer enclosure and said burner duct are cylindrically shaped.

16. A heating apparatus using a solid fuel, comprising:

(a) a jacket;

(b) a solid fuel reservoir having a loading door;

(c) a heart having a base and disposed below said reservoir, said hearth comprising a fire grate placed over an ash pan, said fire grate defining a fire grate level;

(d) a gasifying burner placed in said hearth;

(e) an expansion chamber communicating with said hearth through said gasifying burner; and (f) a heat exchanger disposed after said expansion chamber, said heat exchanger communicating with a chimney;

wherein said gasifying burner is disposed at the fire grate level generally at its center, said gasifying burner comprising an exterior enclosure having a series of openings longitudinally disposed on an upper portion of said exterior enclosure, said openings communicating with the base of the hearth;

said gasifying burner further comprising a burner duct which runs longitudinally inside said exterior enclosure, said burner duct comprising an inlet and an outlet, a space between said burner duct and said exterior enclosure communicating with said inlet of said burner duct;

said gasifying burner further comprising a secondary air inlet disposed near said inlet of said burner duct, and a cover placed over said openings of said exterior enclosure.

17. A heating apparatus in accordance with claim 16 or 9, said apparatus comprising a primary air diffuser located on each side of said base of said hearth.

18. A heating apparatus in accordance with claim 16, wherein said exterior enclosure and said burner duct are cylindrically shaped.

19. A heating apparatus in accordance with claim 16 or 18, said apparatus comprising shoulders made of refractory material placed on each side of the base of the hearth and primary air diffusers adjacent to said shoulders.

20. A heating apparatus using a solid fuel, said apparatus comprising:

(a) a jacket;

(b) a solid fuel reservoir having a loading door;

(c) a hearth disposed below said reservoir and comprising a fire grate placed over an ash pan, said fire grate defining a fire grate level;

(d) a gasifying burner disposed in said hearth;

(e) an expansion chamber communicating with said hearth through said gasifying burner; and (f) a heat exchanger disposed after said expansion chamber, said heat exchanger communicating with a chimney;

said hearth having a base, said apparatus comprising a primary air diffuser located one each side of said base of said hearth; and wherein said gasifying burner is positioned generally at the center at the fire grate level.

21. A heating apparatus in accordance with claim 20, further comprising shoulders made of refractory material placed on each side of said hearth.

22. A heating apparatus in accordance with claim 20 or 21, wherein said gasifying burner comprises:

(a) an interior enclosure having disposed therein a series of openings which communicate with the base of the hearth;

(b) a burner duct which runs longitudinally inside said interior enclosure, said burner duct comprising an inlet and an outlet, a space between said burner duct and said interior enclosure communicating with said inlet of said burner duct; and (c) a secondary air inlet disposed near said inlet of said burner duct.

* * * * *